US006459346B1

(12) United States Patent
Sivadas et al.

(10) Patent No.: US 6,459,346 B1
(45) Date of Patent: Oct. 1, 2002

(54) SIDE-COUPLED MICROWAVE FILTER WITH CIRCUMFERENTIALLY-SPACED IRISES

(75) Inventors: Apu Sivadas, Wellington; Ming Yu, Waterloo; David Smith, Cambridge; William Fitzpatrick, Waterloo, all of (CA)

(73) Assignee: COM DEV Limited, Cambridge (CA)

( * ) Notice: Subject to any disclaimer, the term of this patent is extended or adjusted under 35 U.S.C. 154(b) by 12 days.

(21) Appl. No.: 09/650,479

(22) Filed: Aug. 29, 2000

(51) Int. Cl.[7] ..... H01P 1/208
(52) U.S. Cl. ..... 333/212; 333/208
(58) Field of Search ..... 333/212, 208, 333/230

(56) References Cited

U.S. PATENT DOCUMENTS

| | | | | | |
|---|---|---|---|---|---|
| 3,936,775 | A | | 2/1976 | Snyder | 333/73 W |
| 4,544,901 | A | * | 10/1985 | Rhodes et al. | 333/212 |
| 4,652,843 | A | * | 3/1987 | Tang et al. | 333/212 |
| 4,677,403 | A | | 6/1987 | Kich | 333/229 |
| 4,810,984 | A | | 3/1989 | Arnold et al. | 333/202 |
| 5,027,090 | A | | 6/1991 | Gueble et al. | 333/202 |
| 5,039,966 | A | | 8/1991 | Schmid et al. | 333/229 |
| 5,216,388 | A | | 6/1993 | Dipoala | 331/96 |
| 5,304,968 | A | | 4/1994 | Ohtonen et al. | 333/222 |
| 5,329,255 | A | | 7/1994 | Hayes et al. | 331/96 |
| 5,374,911 | A | | 12/1994 | Kich et al. | 333/209 |
| 5,589,807 | A | | 12/1996 | Tang | 333/121 |
| 5,691,677 | A | | 11/1997 | De Maron et al. | 333/219.1 |
| 5,774,030 | A | | 6/1998 | Gray | 333/121 |
| 5,818,314 | A | | 10/1998 | Baker | 333/226 |
| 5,867,077 | A | | 2/1999 | Lundquist | 333/208 |
| 5,905,419 | A | | 5/1999 | Lukkarila | 333/202 |
| 6,066,996 | A | * | 5/2000 | Goertz et al. | 333/202 |

OTHER PUBLICATIONS

Snyder, "The Dual–Mode Filter—A Realization", Microwave Journal, vol. 17, No. 12; Dec. 1974, pp. 31–33, 63.

* cited by examiner

*Primary Examiner*—Robert Pascal
*Assistant Examiner*—Joseph Chang
(74) *Attorney, Agent, or Firm*—Jones, Day, Reavis & Pogue

(57) ABSTRACT

A microwave filter has a set of irises to couple cavities within the filter. A trifurcated iris comprises a central iris and a pair of peripheral irises. The peripheral irises are configured and oriented to couple a primary mode having a magnetic field in the axial direction of a filter cavity. The central iris is configured and oriented to couple a secondary mode having a magnetic field in the azimuthal direction of the filter cavity. The configuration of the trifurcated iris is further oriented to minimize the influence of higher order signals such as the $TE_{21X}$ mode. The peripheral iris are oriented at null points of the primary $TE_{21X}$ mode and the central iris is also located at a null point. An input and an output iris are configured to receive electromagnetic energy in the axial direction of the filter. The input and output irises are oriented to minimize signals in the $TE_{21X}$ secondary mode and any TM modes.

21 Claims, 4 Drawing Sheets

SIDE-COUPLED MICROWAVE FILTER WITH CIRCUMFERENTIALLY-SPACED IRISES

BACKGROUND

1. Technical Field

This invention relates to the field of microwave filters and resonators.

2. Description of the Related Art

A microwave filter is an electromagnetic circuit that can be tuned to pass energy at a specified resonant frequency. The filter is used in communications applications to filter a signal by removing frequencies that are outside a bandpass frequency range. This type of filter typically includes an input port an output port, and a filter cavity. The bandpass filtering properties of the filter are determined by the size and shape of the filter cavity and by the coupling effects of the filter to the electromagnetic signal.

In many filter applications, it is desirable to filter the signal by passing it through multiple cavities in series. In such an application, it is necessary to form an iris between adjacent cavities to pass the energy from the first cavity to the second cavity. The iris is typically formed on a common wall of both cavities.

SUMMARY OF THE INVENTION

A microwave filter is provided that includes a first filter cavity with a wall centered on a first axis and a second filter cavity with a wall centered on a second axis. The first and second axes are parallel to each other. A central iris is configured and oriented along the wall of the first cavity and extends through the wall of the second cavity. A pair of peripheral irises are equidistantly spaced circumferentially from the central iris. The peripheral irises extend from the wall of the first cavity to the wall of the second cavity. The peripheral irises couple a primary mode of an input electromagnetic signal from the first cavity to the second cavity and the central iris couples a secondary mode of the same input electromagnetic signal from the first cavity to the second cavity.

DETAILED DESCRIPTION OF THE DRAWINGS

Figure 1:
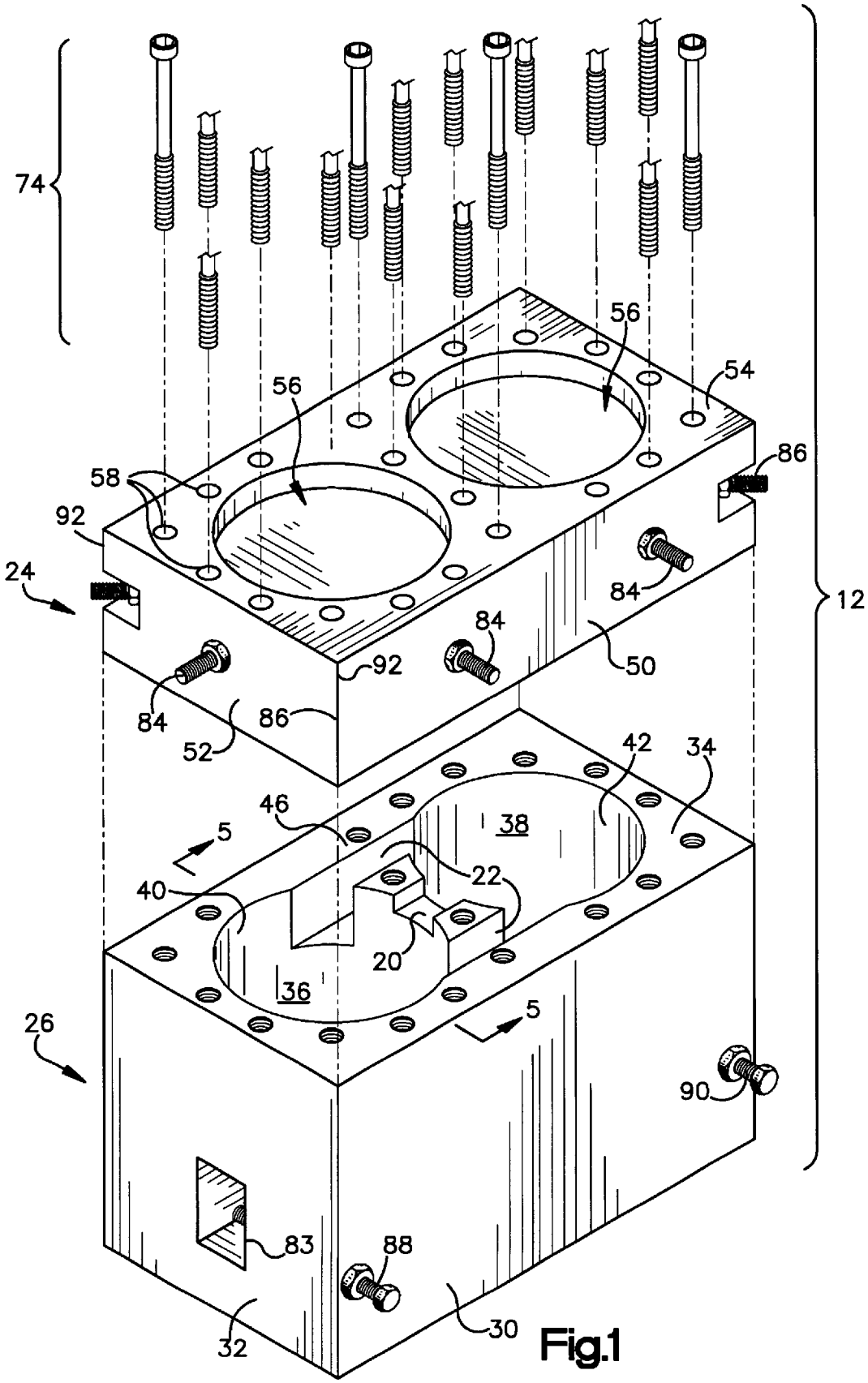
FIG. 1 is an exploded view of an apparatus comprising a preferred embodiment of the present invention.

An apparatus 12 comprising a preferred embodiment of the present invention is shown in FIG. 1. The apparatus 12 is a microwave filter having a centrally located iris 20 and a pair of peripherally located irises 22. The filter 12 comprises an upper structure 24 and a lower structure 26. The upper structure 24 and the lower structure 26 are generally rectangular, block-shaped structures.

Figure 3:
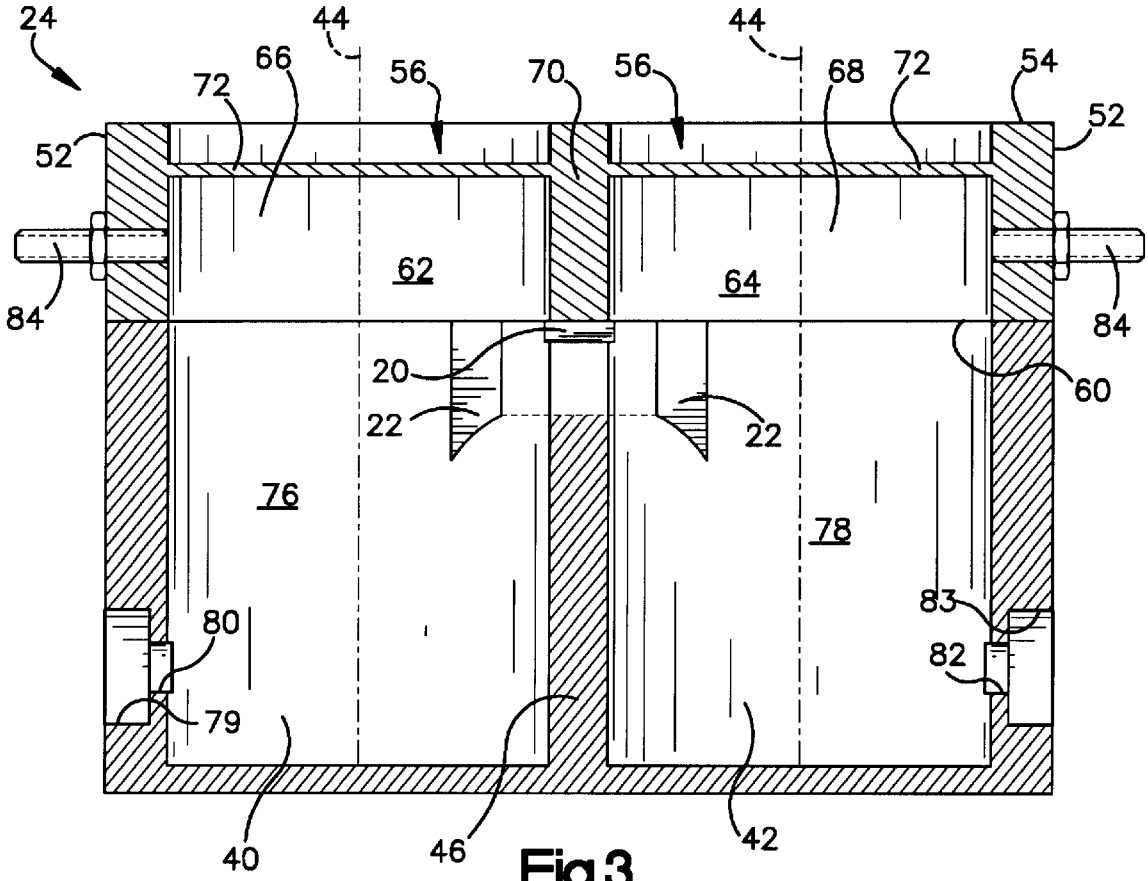
FIG. 3 is a side sectional view of the apparatus.
Figure 4:
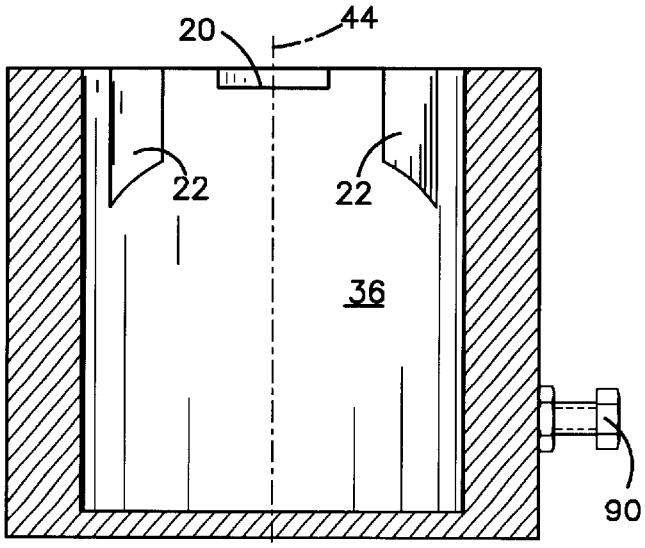
FIG. 4 is a view of the apparatus in FIG. 1 taken along line 5—5.

The lower structure 26 has a pair of side walls 30 and a pair of end walls 32. A mating surface 34 of the lower structure 26 is a planar surface perpendicular to the side walls 30 and end walls 32. A pair of cylindrical recesses 36 and 38 extend into the lower structure 26 and define a pair of cylindrical inner wall surfaces 40 and 42. The first recess 36 is an input recess. The second recess 38 is an output recess. Each recess 36 and 38 is centered on one of a pair of parallel, central axes 44 (shown in FIGS. 3 and 4). The central axes 44 are perpendicular to the mating surface 34. A center wall 46 separates the cylindrical inner wall surfaces 40 and 42 of the input recess 36 and the output recess 38. An array of internally threaded apertures surround the recesses 36 and 38.

Figure 2:
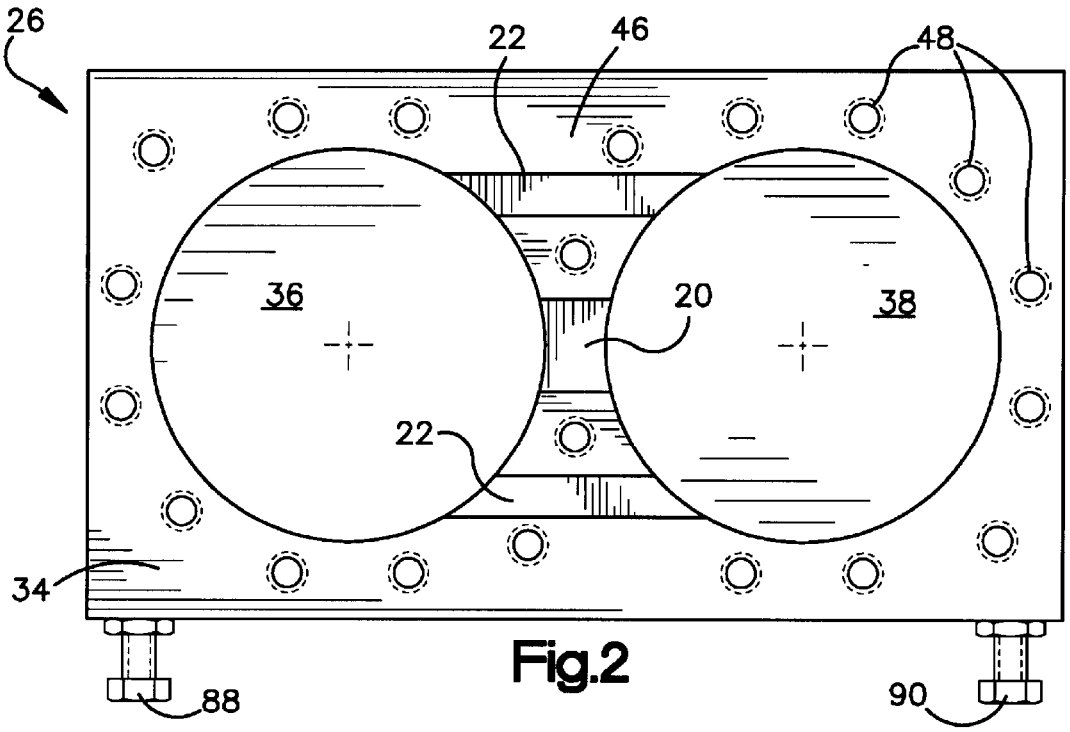
FIG. 2 is a top view of a part of the apparatus shown in FIG. 1.

The central iris 20 (FIG. 2) is formed between the cylindrical recesses 36 and 38 and extends through the center wall 46. The central iris 20 is preferably equidistantly-spaced from the side walls 30 and predominantly extends along the center wall 46 toward the side walls 30. The central iris 20 thus extends circumferentially along the inner wall surfaces 40 and 42. Between each side wall 30 and the central iris 20, the peripheral irises 22 are formed between the cylindrical recesses 36 and 38 through the center wall 46. The peripheral irises 22 are equidistant to the central iris 20 and extend axially along the inner wall surfaces 40 and 42. The recesses 36 and 38 communicate through the irises 20 and 22. The central iris 20 thus extends radially along the inner wall surfaces 40 and 42 while the peripheral irises 22 extend axially along the inner wall surfaces 40 and 42.

The upper structure 24 has a pair of side walls 50 and a pair of end walls 52. A top surface 54 is a planar surface perpendicular to the side walls 50 and end walls 52. A pair of cylindrical, shallow recesses 56 extend into the upper structure 24 along the central axes 44. An array of apertures 58 extend circumferentially around each shallow recess 56 and fully through the upper structure 24. A mating surface 60 (FIG. 3) is a planar bottom surface perpendicular to both the side walls 50 and end walls 52.

The upper structure 24 has a pair of cylindrical recesses 62 and 64 that extend into the upper structure 24 from the mating surface 60. The recesses 62 and 64 are defined by a pair of cylindrical inner wall surface 66 and 68 centered on the central axes 44. A center wall separates the inner wall surfaces 66 and 68. The recesses 62 and 64 are machined to a depth short of reaching the surface recesses 56 on the top surface 54. Accordingly, a thin circular wall 72 separates the surface recesses 56 on the top surface 54 from the cylindrical recesses 62 and 64 extending from the mating surface 60.

The filter 12 is assembled by moving the two mating surfaces 34 and 60 into abutment with each other. The upper structure 24 is fastened to the lower structure 26 by a set of screws 74. These screws 74 are received through the apertures 58 in the upper structure 24 and are screwed into the threaded apertures on the mating surface 34 of the lower structure 26. The inner 12 wall surfaces 66 and 68 of the upper structure 24 are then aligned with the inner wall surfaces 40 and 42 of the lower structure 26. The recesses 62 and 64 in the upper structure 24 are thus aligned with the recesses 36 and 38 in the lower structure 26.

An input cavity 76 (FIG. 3) is enclosed by the inner wall surfaces 40 and 66. Similarly, an output cavity 78 is enclosed by the inner wall surfaces 42 and 68. The mating surfaces 34 and 60 are tightly engaged to ensure electrical continuity across the inner wall surfaces 40 and 66 as well as the inner wall surfaces 42 and 68. An input waveguide 79 is formed in the end wall 32 and extends toward the input cavity 76, but does not extend into the input cavity 76. An input iris 80 is formed through the input waveguide 79 of the end wall 32 and into the input cavity 76 through the inner wall surface 40. An output iris 82 is formed through the inner wall surface 42 of the output cavity 78 and extends toward an output waveguide 83. The output waveguide is formed in the end wall 32 and extends toward the output cavity 78, but does not extend into the output cavity 78. The input iris 80 couples the input cavity 76 to an input device through the input waveguide 79 and the output iris 82 couples the output cavity 78 to an output device through the output waveguide 83.

A number of adjusting screws are used within the filter 12 including: tuning screws 84, coupling screws 86, and input/output screws 88 and 90. The tuning screws 84 are perpendicular to and extend through the side walls 30 and end walls 32. Each cavity receives a pair of tuning screws 84 orthogonally-located with respect to each other along the inner wall surfaces and 68. Each cavity receives a coupling screw 86 diagonally-oriented relative to the tuning screws 84 at a corner 92 of the upper structure 24. The input screw 88 extends from the side wall 30 into the input iris 80. The output screw 90 extends from the side wall 30 into the output iris 82.

The two piece design of the filter 12 is configured so the irises 20 and 22 can be formed on the surface 34 of the lower structure 26 but also orients the irises 20 and 22 away from the thin wall 72. By adjusting the relative heights of the upper and lower structure 24 and 26, the irises 20 and 22 can be oriented at a desired position on the center wall 46 along the central axis 44.

The trifurcated iris arrangement of the irises 20 and 22 reduces the influence of higher order modes in the output signal. This is done by using the properties of the fundamental mode, such as $TE_{11}$, and the higher order modes, such as $TE_{21}$, as these modes resonate in the filter 12. Each of these modes, $TE_{11}$ and $TE_{21}$, has a primary and a secondary mode based on the direction of the polarization of the electric field. The central iris 20 is configured to couple the magnetic field energy oriented in the azimuthal direction. The peripheral irises 22 are configured to couple the magnetic field energy oriented in the axial direction.

Figure 5:
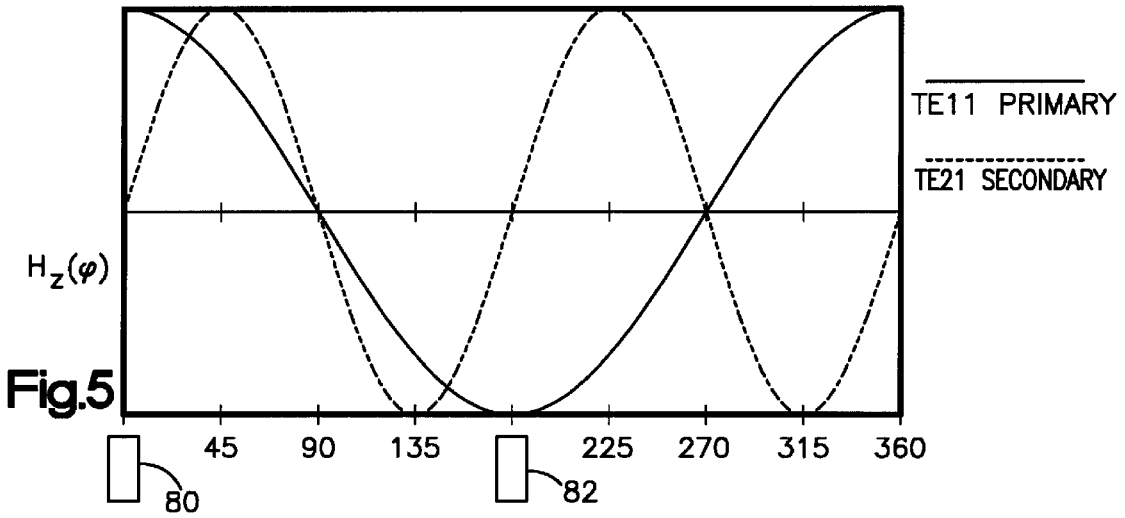
FIGS. 5–7 are curves of the azimuthal variation of the strength of the magnetic fields within the cavity of the apparatus shown in FIG. 1.
Figure 6:
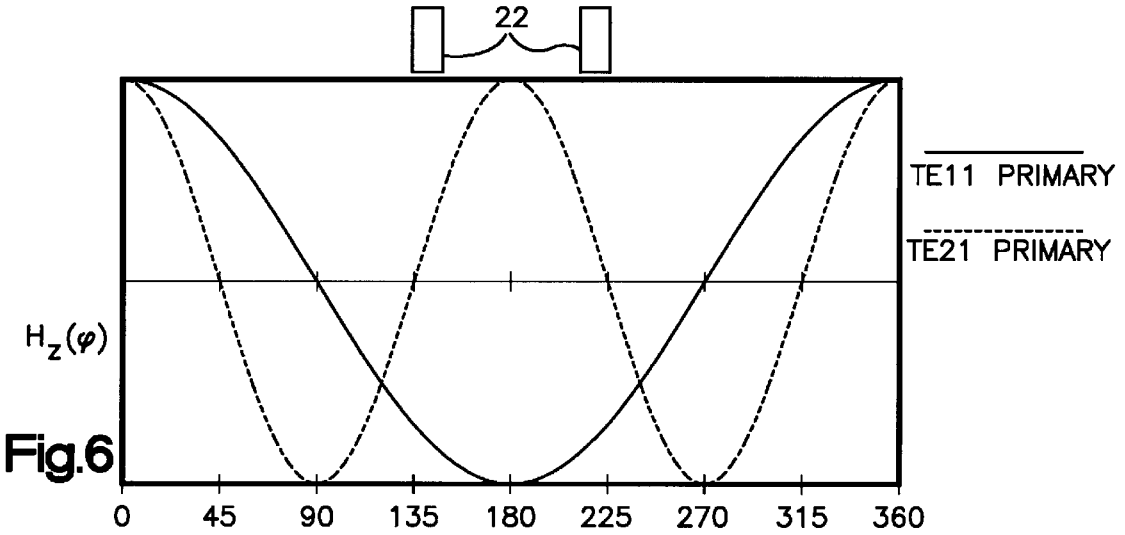
Figure 7:
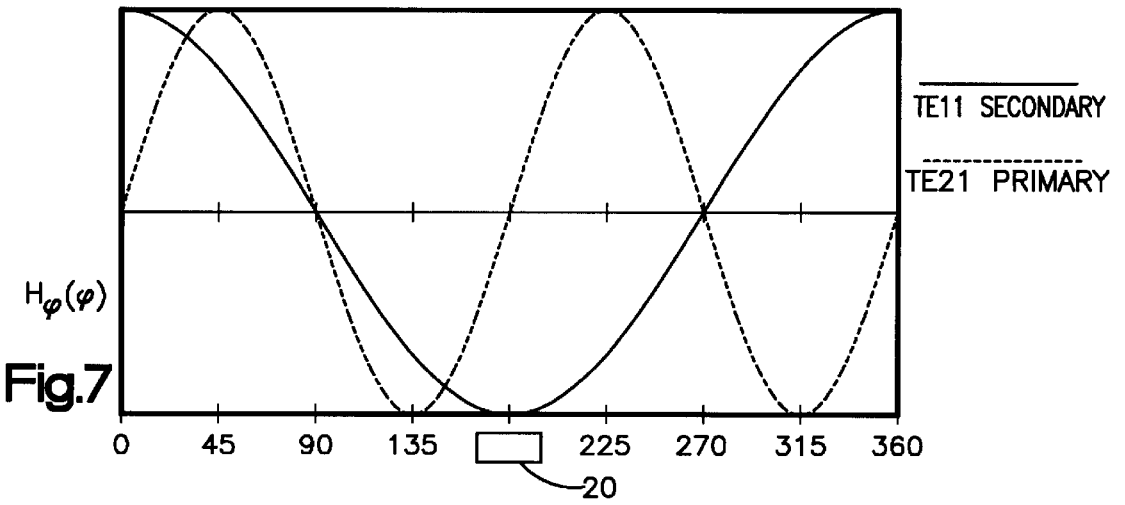

The curves shown in FIGS. 5–7 set forth distributions of the strength of the magnetic fields in the azimuthal direction ($He_\Phi$) and in the axial direction ($H_z$) inside the filter 12 with respect to the azimuth angle ($\Phi$). The azimuth angle $\Phi$ is preferably measured about the central axis 44 of the input cavity 76. The input iris 80 is taken as the 0° measurement. The central iris 20 is located at 180°. The peripheral irises 22 are preferably located at +/−45° relative to the central iris 20 at positions of 135° and 225°. In the output cavity 78, the output iris 82 is located at 180°. While this reference frame has been adopted for the explanation of FIGS. 5–7 it is understood that any comparable reference frame may be used.

In the curves of FIG. 5, the field $H_z$ of the $TE_{11}$ primary mode and $TE_{21}$ secondary mode are shown with respect to the placement of the input iris 80 and output iris 82. The magnetic field of the $TE_{21}$ secondary mode is null at the input iris 80 and the output iris 82, therefore no energy from the $TE_{21}$ secondary mode enters the filter 12. The magnetic field of the $TE_{11}$ primary mode is maximal at the input iris 80 and output iris 82, therefore the energy from the $TE_{11}$ primary mode resonates in the filter 12. The input iris 80 thus allows energy to enter the filter 12 in the $TE_{11}$ and the $TE_{21}$ primary modes.

Within the filter 12, the $TE_{11}$ primary mode is coupled to the $TE_{11}$ secondary mode by the coupling screws 86. The coupling screws 86 couple the energy in the $TE_{11}$ primary mode to the orthogonal $TE_{11}$ secondary mode. Neither the coupling screws 86 nor the tuning screws 84 couple the energy in the $TE_{21}$ primary mode,because these screws 84 and 86 are located at either a maxima or a null value of the radial electric field.

The curves of FIG. 6 plot the magnetic field $H_z$ as a function of the azimuth angle $\Phi$ for the $TE_{11}$ primary and $TE_{21}$ primary modes. This energy is coupled to the output cavity 78 through the peripheral irises 22, which extend in the axial direction. The $TE_{11}$ primary mode has a non-zero value at the peripheral irises 22. The $TE_{21}$ primary mode has zero magnetic field at both of these irises 22. If the filter 12 is perturbed slightly, and the curves shift either to the left or the right, the magnitude of the $TE_{21}$ primary mode would be non-zero and equal at each iris 22. The direction of the magnetic field at each iris 22, however, would be opposite. Therefore, the peripheral irises 22 prevent any energy transfer to the output signal through the $TE_{21}$ primary mode.

The curves of FIG. 7 plot the magnetic field $H_\Phi$ as a function of the azimuth angle $\Phi$ for the $TE_{11}$ secondary and $TE_{21}$ primary modes. This energy is coupled through the central iris 20 into the output cavity 78 because the central iris 20 primarily extends in the azimuthal direction around the wall of the input cavity 76. The $TE_{11}$ secondary mode has a maximum magnitude at the center of the central iris 20 to couple energy from the $TE_{11}$ secondary mode from the input cavity 76 to the output cavity 78. The $TE_{21}$ primary mode has a null field at the center of the central iris 20. The $TE_{21}$ primary mode is odd about the center and energy on one side of the center cancels energy on the other side of the center. The $TE_{21}$ primary mode thus does not pass energy from the input cavity 76 to the output cavity 78.

The curves of FIG. 5–7 thus show an iris configuration where energy from the $TE_{11}$ modes are fully coupled to the filter 12 and then coupled between the cavities 76 and 78. This iris configuration further reduces the propagation of the $TE_{21}$ modes by cancellation effects of the irises in the center wall and through use of null field points in the filter 12. The axially-extending input and output irises 80, 82 also do not couple any of the TM modes into the filter 12 because the TM mode does not have an axial magnetic field.

The configuration of these irises 20, 22, 80, and 82 filters the input signal in an elliptical filtering pattern. This elliptical filtering pattern reduces the amount of spurious signals that are propagated through the filter 12, and into the output signal, because the elliptical filtering pattern attenuates all signals that are outside the notched band of the filter. The orientations and the placements of the irises with respect to the orientations of the electromagnetic fields of the input signal are configured such that the poles and zeros of the elliptical filtering pattern notch the desired signal while attenuating frequencies outside of the desired bandpass frequencies.

The invention has been described with reference to a preferred embodiment. Those skilled in the art will perceive improvements, changes, and modifications. Such improvements, changes, and modifications are intended to be within the scope of the claims.

The following is claimed:

1. A microwave filter, comprising:

a first filter cavity having a wall centered on a first axis, the first cavity having an input iris formed through the first filter cavity wall;

a second filter cavity having a wall centered on a second axis, the second axis being parallel to the first axis, the second cavity having an output iris formed through the second filter cavity wall, wherein the first cavity is separated from the second cavity by a center wall;

a central iris extending through the center wall between the first cavity and the second cavity; and a pair of peripheral irises positioned on opposite sides of the central iris and being equidistantly-spaced radially therefrom, said peripheral irises extending through the center wall between the first cavity and the second cavity;

wherein the peripheral irises couple a first mode from the first cavity to the second cavity, and the central iris couples a second mode from the first cavity to the second cavity, said first and second modes falling within a single passband.

2. The microwave filter as defined in claim 1, wherein the peripheral irises are configured to substantially extend in the axial direction of the center wall and to couple electromagnetic energy from the electromagnetic field oriented in the axial direction of the center wall.

3. The microwave filter as defined in claim 2, wherein the peripheral irises are oriented at null positions in the circumferential direction of the $TE_{21X}$ mode, where X is an integer.

4. The microwave filter as defined in claim 1, wherein the central iris is formed to substantially extend in the circumferential direction of the center wall and to couple electromagnetic energy from the electromagnetic field oriented in the azimuthal direction of the center wall.

5. The microwave filter as defined in claim 4, wherein the central iris is oriented at a null position in the azimuthal direction of the $TE_{21X}$ mode, where X is an integer.

6. The microwave filter as defined in claim 1, wherein the first cavity resonates $TE_{11X}$ modes, where X is an integer.

7. The microwave filter as defined in claim 1, wherein the input iris is oriented radially opposite of the central iris.

8. The microwave filter as defined in claim 7, wherein the input iris is formed to substantially extend in the axial direction of the first cavity wall and to isolate the filter from electromagnetic fields in the axial direction.

9. The microwave filter as defined in claim 1, wherein the output iris is oriented radially opposite of the central iris.

10. The microwave filter as defined in claim 9, wherein the output iris is formed to substantially extend in the axial direction of the center wall and to isolate the filter from electromagnetic fields in the axial direction.

11. A single passband microwave filter, comprising:

a pair of filter cavities positioned adjacent each other, each cavity having a cylindrical wall centered on one of a pair of parallel axes, with a center wall positioned between the pair of filter cavities; and coupling iris structure having at least three openings positioned on the center wall between the pair of filter cavities, said at least three openings in the iris structure extending through the center wall in a direction perpendicular to the parallel axes, extending axially along the axes, and extending circumferentially along the center wall such that the coupling iris structure couples an orthogonally-related pair of electromagnetic signals between the cavities in a single passband.

12. The microwave filter as defined in claim 11, wherein the cavities resonate $TE_{11X}$ modes, where X is an integer.

13. The microwave filter as defined in claim 11, further comprising an input iris located on the first cavity wall of one of the pair of cavities oriented radially opposite the coupling iris structure.

14. The microwave filter as defined in claim 13, wherein the input iris is formed to substantially extend in the axial direction of the first cavity wall, the input iris isolating the filter from electromagnetic fields in the axial direction.

15. A single passband microwave filter, comprising:

a first filter cavity having a wall centered on a first axis, the first cavity having an input iris formed through the wall;

a second filter cavity having a wall centered on a second axis, wherein the first filter cavity is positioned adjacent the second filter cavity and a center wall is positioned between the first and second cavities;

a trifurcated coupling iris structure positioned on the center wall and oriented radially opposite the input iris such that the trifurcated coupling iris structure couples an orthogonally-related pair of electromagnetic signals between the first and second filter cavities in a single passband.

16. The microwave filter of claim 15, wherein the trifurcated coupling iris structure comprises a central coupling iris substantially extending in the circumferential direction of the center wall to couple an electromagnetic signal oriented in the azimuthal direction of the center wall.

17. The microwave filter as defined in claim 16, wherein the central coupling iris is oriented at a null position in the azimuthal direction of the $TE_{21X}$ mode, where X is an integer.

18. The microwave filter of claim 16, wherein the trifurcated coupling iris structure further comprises peripheral coupling irises substantially extending in the axial direction of the center wall to couple an electromagnetic signal oriented in the axial direction of the center wall.

19. The microwave filter as defined in claim 18, wherein the trifurcated peripheral coupling irises are oriented at null positions in the circumferential direction of the $TE_{21X}$ mode, where X is an integer.

20. The microwave filter as defined in claim 15, wherein the input iris is formed to substantially extend in the axial direction of the first cavity wall, the input iris isolating the filter from electromagnetic fields in the axial direction.

21. A microwave filter comprising:

a first filter cavity having an input iris;

a second filter cavity having an output iris, said second filter cavity positioned adjacent the first filter cavity with a center wall formed therebetween; and a trifurcated iris structure positioned in said center wall and comprising a centrally positioned central iris and a pair of peripheral irises that are a mirror-image of one another positioned on opposite sides of the central iris at equally-spaced distances therefrom, wherein the trifurcated iris structure is configured to allow two modes to resonate between the first and second cavities.

* * * * *

UNITED STATES PATENT AND TRADEMARK OFFICE

CERTIFICATE OF CORRECTION

PATENT NO. : 6,459,346 B1
DATED : October 1, 2002
INVENTOR(S) : Sivadas et al.

It is certified that error appears in the above-identified patent and that said Letters Patent is hereby corrected as shown below:

Column 5,
Line 52, before “coupling” insert -- a --.

Signed and Sealed this

Twelfth Day of August, 2003

JAMES E. ROGAN
*Director of the United States Patent and Trademark Office*